US006619482B1

(12) United States Patent
King

(10) Patent No.: US 6,619,482 B1
(45) Date of Patent: Sep. 16, 2003

(54) MEDICINE CADDY

(76) Inventor: Sonya King, 4225 S. Borough Rd., Florence, SC (US) 29501

( * ) Notice: Subject to any disclaimer, the term of this patent is extended or adjusted under 35 U.S.C. 154(b) by 0 days.

(21) Appl. No.: 09/901,333

(22) Filed: Jul. 9, 2001

Related U.S. Application Data

(60) Provisional application No. 60/217,044, filed on Jul. 10, 2000.

(51) Int. Cl.[7] ..... B65D 1/22

(52) U.S. Cl. ..... 206/747; 220/520; 220/23.8; 211/168

(58) Field of Search ..... 206/747, 749, 206/538, 539, 144, 192; 220/520, 23.8, 23.2, 507; 211/168

(56) References Cited

U.S. PATENT DOCUMENTS

| | | | | |
|---|---|---|---|---|
| 623,468 | A | | 4/1899 | Forbes |
| 723,964 | A | | 3/1903 | Wilson |
| 1,687,138 | A | | 10/1928 | Myers |
| 1,928,594 | A | | 9/1933 | Kearney |
| 2,173,917 | A | | 9/1939 | Ryan |
| 3,186,556 | A | | 6/1965 | Forsstrom |
| 4,667,822 | A | | 5/1987 | Coopmans |
| 4,779,914 | A | | 10/1988 | Friedline |
| 5,062,531 | A | | 11/1991 | Coy |
| D340,803 | S | * | 11/1993 | Bradford et al. ..... D3/283 |
| 5,304,077 | A | * | 4/1994 | Provenzale ..... 439/347 |
| 5,388,697 | A | * | 2/1995 | James ..... 116/200 |
| 5,495,947 | A | * | 3/1996 | Zarske ..... 206/315.1 |
| 5,676,240 | A | * | 10/1997 | Cziraky et al. ..... 206/1.7 |
| D412,061 | S | * | 7/1999 | Yemini ..... D3/282 |

* cited by examiner

*Primary Examiner*—J. Mohandesi
(74) *Attorney, Agent, or Firm*—Nelson Mullins Riley & Scarborough

(57) ABSTRACT

A medicine caddy having a first caddy portion and a second caddy portion connectable to each other. The first and second caddy portions are movable with respect to one another between a first countertop configuration and a second carrying configuration. Moreover, the caddy portions each define a plurality of container holes for receipt of respective medicine containers. At least one of the caddy portions includes a handle by which the medicine caddy can be transported when in the carrying configuration.

12 Claims, 4 Drawing Sheets

MEDICINE CADDY

This application claims the benefit of copending provisional application Ser. No. 60/217,044, filed Jul. 10, 2000, which is relied on herein and incorporated herein by reference.

BACKGROUND OF THE INVENTION

The present invention relates generally to a caddy configured to hold a plurality of medicine containers.

Often, individuals or different members of a family must take multiple medications over the course of a single day. The various containers for these medicines are typically stored in a medicine cabinet located in a bathroom. One problem with the use of a medicine cabinet, however, is that the cabinet is frequently filled with other types of personal hygiene products, such as toothpaste, deodorant and the like. After these other products are placed in the medicine cabinet, there is often insufficient space remaining for more than a few medicine containers. In addition, the individual medicine containers stored in a medicine cabinet are not easily transportable as a group.

It is also known to store medicine containers in a basket, which the user can move from room to room. The use of a basket is often considered undesirable, however, because some of the medicine containers will have a tendency to tumble out of the basket when another container is removed.

U.S. Pat. No. 5,062,531 to Coy, incorporated herein by reference, discloses a caddy for medicine containers. The caddy of this reference takes the form of a tray which has a number of recesses defined in its top. Each of the recesses is configured to hold a respective medicine container.

While the medicine caddy shown in the '531 patent solves some problems of the prior art, it is not without disadvantages. For example, this device has a holding aperture defined in the top of the tray by which it is lifted and carried. The tip of the user's index finger is positioned in the holding aperture so that a corner area of the caddy can be pinched between the user's thumb and second finger. It will be appreciated that such a lifting technique is awkward, and severely limits both the size of the caddy and the number of medicine containers that can be carried thereby.

SUMMARY OF THE INVENTION

The present invention recognizes and addresses the foregoing disadvantages, and others, of prior art constructions and methods.

Accordingly, it is an object of the present invention to provide an improved medicine caddy.

It is a further object of the present invention to provide an improved medicine caddy which is capable of holding a relatively large number of medicine containers.

It is a more particular object of the present invention to provide an improved medicine caddy which may be easily carried from place to place.

It is a more particular object of the present invention to provide an improved medicine caddy which is convertible between a first countertop configuration and a second carrying configuration.

Some of these objects are achieved by a medicine caddy having a first caddy portion connectable to a second caddy portion. Preferably, the two caddy portions are movable with respect to each other between a first countertop configuration and a second carrying configuration. Each of the caddy portions preferably defines a plurality of holes (i.e., recesses) for holding respective medicine containers. One or both of the caddy portions preferably includes a handle by which the caddy can be transported when in the carrying configuration. Each of the caddy portions may be configured having two shelves each defining a respective row of holes for holding the respective medicine containers.

Other objects, features and aspects of the present invention are provided by various combinations and subcombinations of the disclosed elements, as well as methods of utilizing same, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
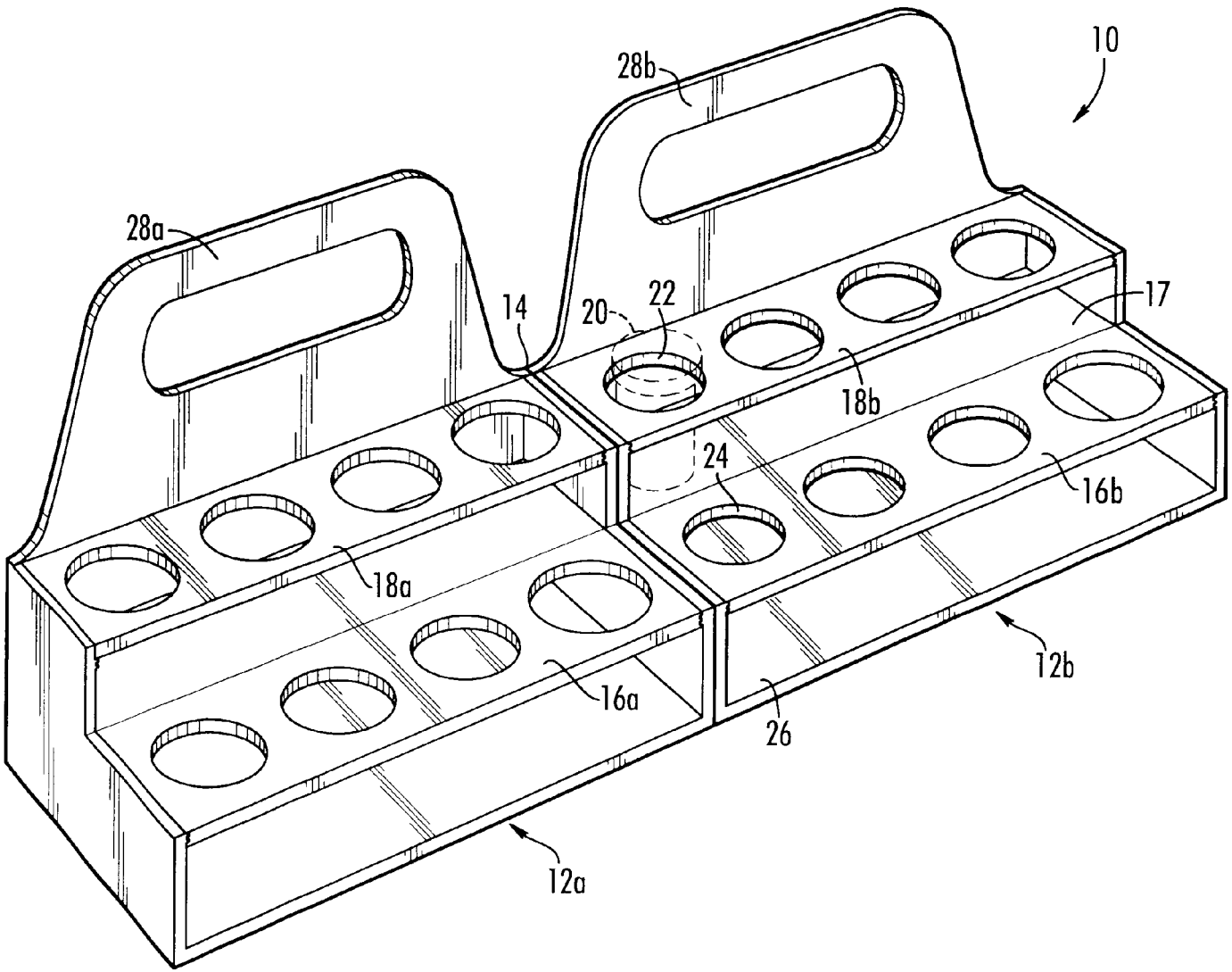
FIG. 1 is a perspective view of an improved medicine caddy constructed in accordance with the present invention in the first countertop configuration.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the invention, which broader aspects are embodied in the exemplary constructions.

Figure 2:
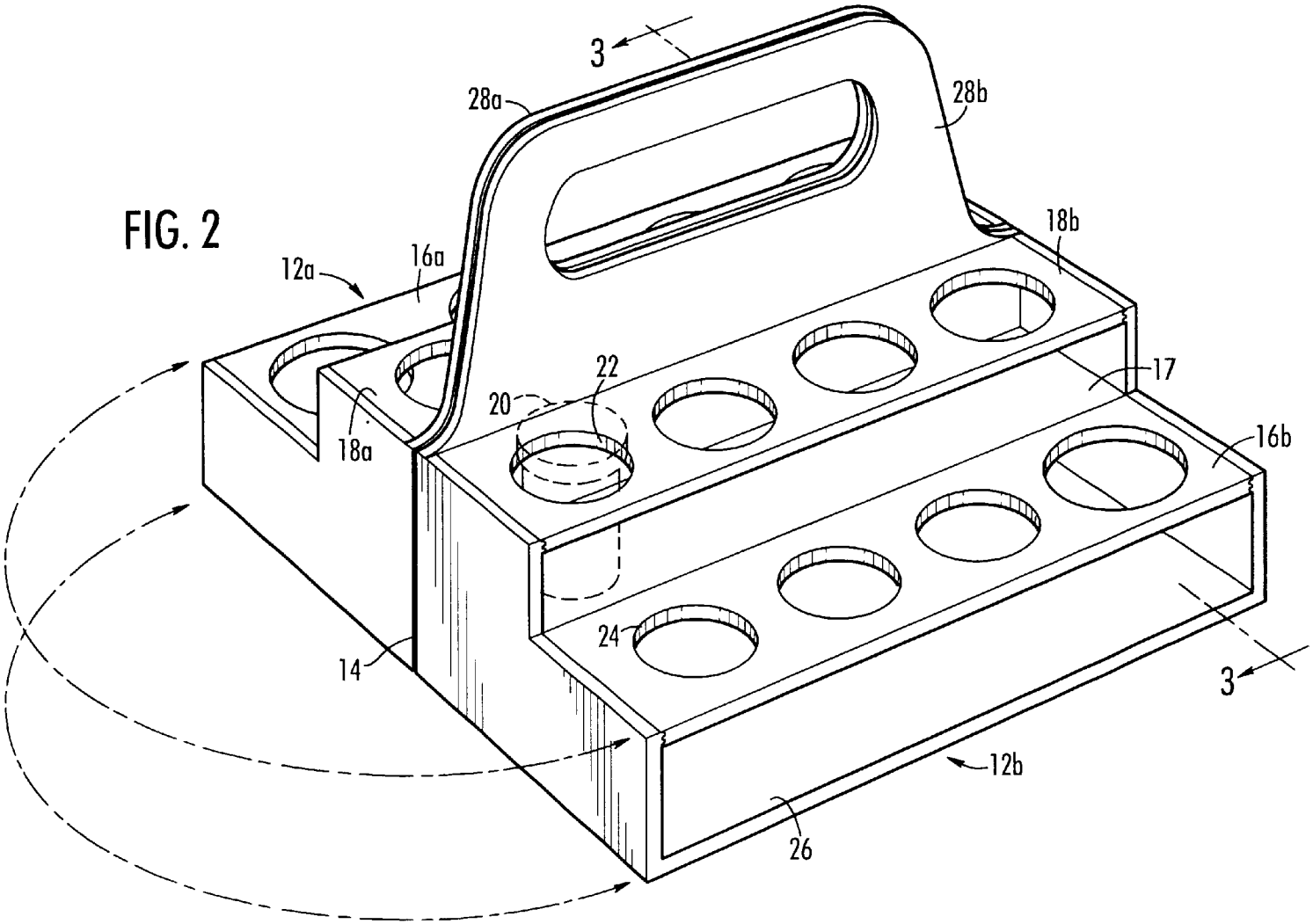
FIG. 2 illustrates the medicine caddy of FIG. 1 converted to the second carrying configuration.

Referring now to FIGS. 1–2, one embodiment of an improved medicine caddy constructed in accordance with the invention is illustrated. As shown, medicine caddy 10 includes a first caddy portion 12*a* and a second caddy portion 12*b*. First caddy portion 12*a* and second caddy portion 12*b* are preferably hinged along their adjacent back corners (as indicated at 14) so as to be convertible between a first "countertop" configuration (FIG. 1) and a second carrying configuration (FIG. 2).

In the illustrated embodiment, caddy portions 12*a* and 12*b* are each configured having a pair of "shelves" located at different levels. For example, caddy portion 12*a* has lower shelf 16*a* and upper shelf 18*a*. Similarly, caddy portion 12*b* has lower shelf 16*b* and upper shelf 18*b*. In the countertop configuration, lower shelves 16*a* and 16*b* are aligned so as to form a single lower shelf. Similarly, upper shelves 18*a* and 18*b* are aligned in the countertop configuration so as to form a continuous upper shelf.

Medicine containers are received in respective holes defined in the shelves. For example, a medicine container 20 (shown in broken lines) is received in a hole 22 defined in upper shelf 18*b*. As shown, the bottom of medicine container 20 rests on the upper surface of stepped base 17 located in the same horizontal plane with shelf 16*b*. A medicine container placed in a hole (such as hole 24) defined in lower shelf 16*b* will rest on the upper surface of the lower base 26.

Figure 3:
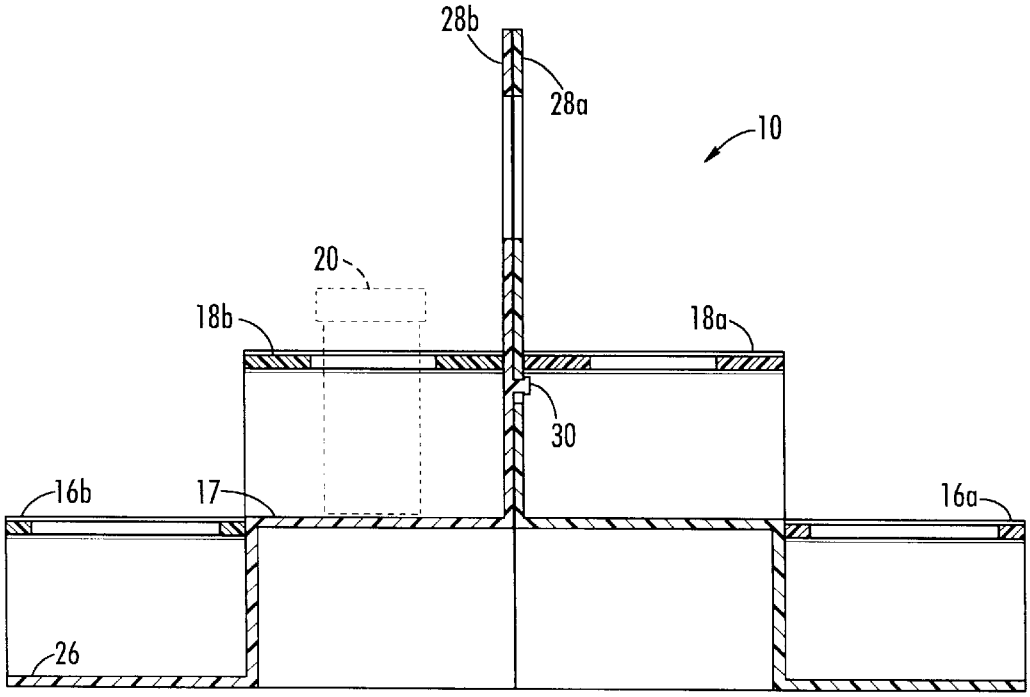
FIG. 3 is a cross-sectional view as taken along line 3—3 of FIG. 2.

It will be appreciated that the holes defined in the shelves may be of varying diameters to permit medicine containers of different sizes to be snugly received. As shown in FIG. 3, for example, all of the holes in lower shelves 16*a–b* may be of a larger diameter, with the holes defined in upper shelves 18*a–b* being of a smaller diameter. As one skilled in the art will appreciate, the number of such holes that may be provided will depend upon the dimensions of caddy 10. Thus, a larger caddy will generally be able to hold a greater number of medicine containers than a smaller caddy.

Preferably, caddy portions 12*a* and 12*b* will be equipped with respective handles 28*a–b*. In this case, handles 28*a–b* are formed coextensive with the back wall of the respective caddy portion so as to register when caddy 10 is converted to the carrying configuration. In this manner, handles 28*a–b* may form a single larger handle which may be conveniently grasped by a user. It should be appreciated, however, that it is not necessary to have handles on both of the caddy portions, since a single handle will also allow caddy 10 to be carried.

In the illustrated embodiment, caddy portions 12*a* and 12*b* are constructed of any suitable material providing the desired combination of low weight and adequate rigidity, such as molded plastic. For example, the majority of each caddy portion may be made of a single piece of molded plastic. The respective upper and lower shelves may be formed as separate elements, which are later assembled onto the molded plastic piece.

Figure 4:
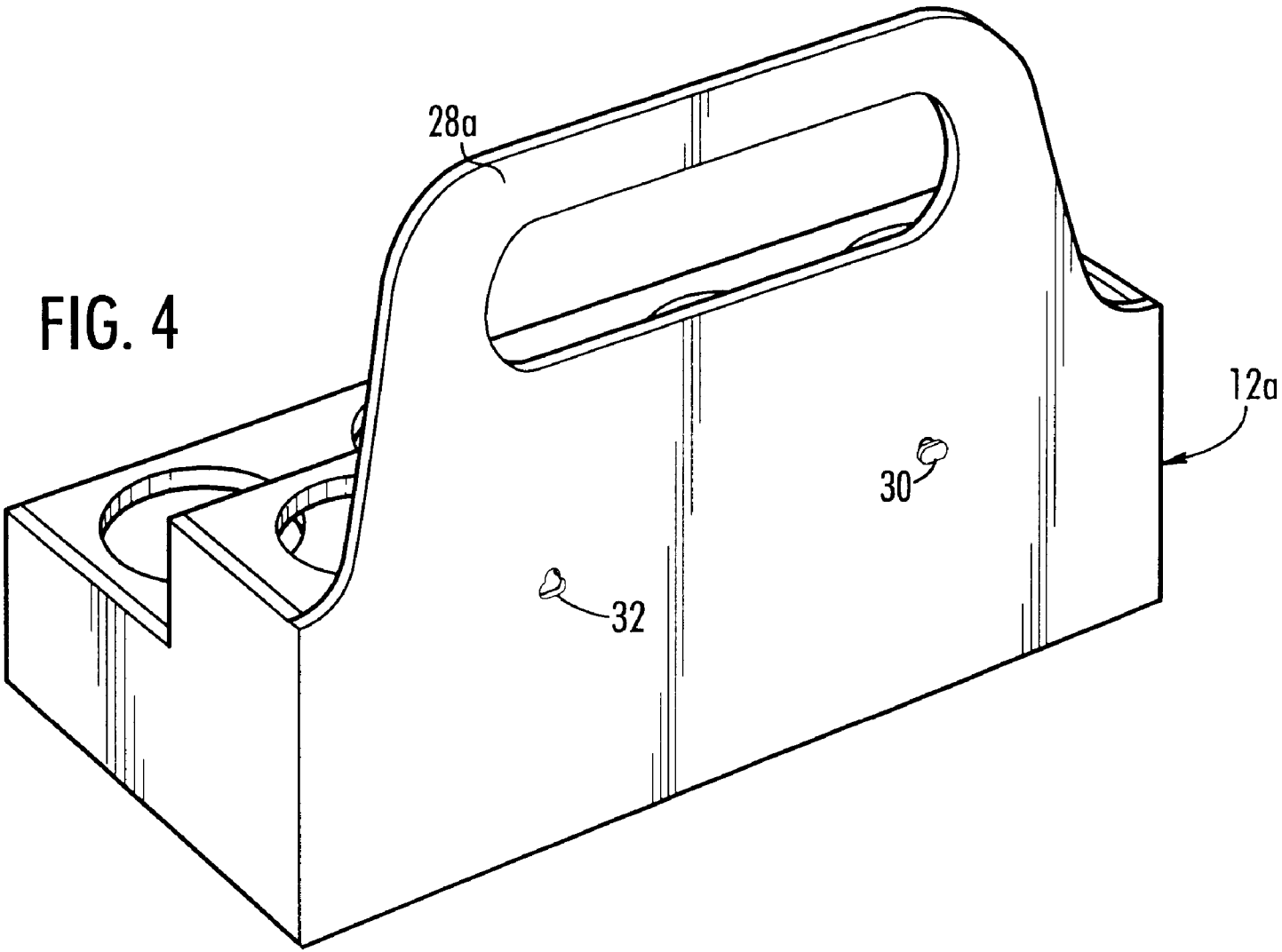
FIG. 4 is a back perspective view of one of the caddy portions of the caddy shown in FIG. 1.

Referring now to FIG. 4, each of the caddy portions may be equipped with a suitable mechanism to releasably maintain caddy 10 in the carrying configuration. In this case, for example, the mechanism is formed by a pair of lug and slot connectors. The lug of each such connector will be located on one of the caddy portions, with the slot being located on the other.

For example, caddy portion 12*a* includes a protruding lug 30 and a receiving slot 32. Lug 30 is received in a corresponding slot in caddy portion 12*b* when caddy 10 is converted to the carrying configuration. Similarly, a lug located on the back of caddy portion 12*b* will engage slot 32 when the caddy is in the carrying configuration. In this manner, the carrying configuration will be maintained until the user decides to convert caddy 10 to the countertop configuration. One skilled in the art will appreciate, however, that both lugs may be maintained on a single caddy portion to engage both slots maintained on the other caddy portion. In other words, it is not necessary that each caddy portion contain both a lug and a slot.

It can thus be seen that the present invention provides an improved medicine caddy in furtherance of the objects noted above. The caddy may be easily converted between a carrying configuration and a countertop configuration. In the carrying configuration, the caddy is easily movable from place to place by the user. In the countertop configuration, the caddy may be located against the back wall of a countertop so as to be unobtrusive while still permitting easy access to the medicine containers that it holds.

As one skilled in the art will appreciate, the present invention is not limited to embodiments in which the two portions are hinged together. In fact, two separable portions may be connected using complementary lug and slot connectors as described above. In other words, the portions may be exactly as shown and described above, but without the interconnecting hinge. When the countertop configuration is desired, the two portions are separated and aligned on the countertop by the user.

While preferred embodiments of the invention have been shown and described, modifications and variations may be made thereto by those of ordinary skill in the art without departing from the spirit and scope of the present invention. In addition, it should be understood that aspects of the various embodiments may be interchanged both in whole or in part. Furthermore, those of ordinary skill in the art will appreciate that the foregoing description is by way of example only and is not intended to be limitative of the invention.

What is claimed is:

1. A medicine caddy comprising:

a first caddy portion;

a second caddy portion;

said first and second caddy portions being movable with respect to one another between a first countertop configuration and a second carrying configuration;

in said second carrying configuration, said first and second caddy portions being back-to-back and maintained together by a hidden locking mechanism; said hidden locking mechanism including a lug on a back portion of the first caddy portion engaging a connector slot defined on a back portion of said second caddy portion; to more particularly point out and distinctly claim the subject matter which the applicant regards as the invention;

each of said caddy portions defining a plurality of container holes for receipt of respective medicine containers; and at least one of said caddy portions including a handle by which the medicine caddy can be transported when in the carrying configuration.

2. A medicine caddy as set forth in claim 1, wherein each of said caddy portions defines a plurality of shelves where said container holes are located.

3. A medicine caddy as set forth in claim 2, wherein said shelves of said first caddy portion and said shelves of said second caddy portion align in the first countertop configuration so as to produce continuous longer shelves.

4. A medicine caddy as set forth in claim 2, wherein a bottom of said container holes defined in a higher shelf of said plurality of shelves are aligned with a top of a next lower shelf in said plurality of shelves.

5. A medicine caddy set forth in claim 1, wherein each of said caddy portions includes a respective handle which are juxtaposed to one another to form a single handle when said medicine caddy is in the carrying configuration.

6. A medicine caddy as set forth in claim 2, wherein first container holes defined in a first shelf of said plurality of shelves have a different diameter than second container holes defined in a second shelf of said plurality of shelves.

7. A medicine caddy as set forth in claim 6, wherein said first container holes have a larger diameter than said second container holes.

8. A medicine caddy set forth in claim 1, wherein said caddy portions are oriented at 180 degrees of angular separation in the first countertop configuration and no angular separation in the second carrying configuration.

9. A medicine caddy as set forth in claim 8, wherein said first caddy portion and said second caddy portion are pivotally connected to one another.

10. A medicine caddy as set forth in claim 1, wherein said locking mechanism includes at least two of said lugs respectively mating with at least two of said connector slots.

11. A medicine caddy as set forth in clam 10, wherein:

said first caddy portion has one of said lugs mating with a corresponding one of said connector slots on said second caddy portion; and said second caddy portion has another of said lugs mating with a corresponding another of said connector slots on said first caddy portion.

12. A medicine caddy comprising:

a first caddy portion;

a second caddy portion;

said first and second caddy portions being movable with respect to one another between a first countertop configuration and a second carrying configuration;

in said second carrying configuration, said first and second caddy portions being back-to-back and maintained together by a hidden locking mechanism, said hidden locking mechanism including a lug on a back portion of said first caddy portion engaging a connector slot defined on a back portion of said second caddy portion; to more particularly point out and distinctly claim the subject matter which the applicant regards as the invention.

each of said caddy portions defining a plurality of shelves, each of which has a plurality of container holes for receipt of respective medicine containers;

said shelves of said second caddy portion aligning in the first countertop configuration with said shelves of said first caddy portion so as to produce continuous longer shelves;

said first and second caddy portions being back-to-back to one another in said second carrying configuration; and at least one of said caddy portions including a handle by which the medicine caddy can be transported when in the carrying configuration.

* * * * *